United States Patent [19]

Graye

[11] Patent Number: 4,976,005

[45] Date of Patent: Dec. 11, 1990

[54] CLEANING TOOL WITH DEMAND-RESPONSIVE AIR PORT

[76] Inventor: Dale L. Graye, P.O. Box 703, Wayzata, Minn. 55391

[21] Appl. No.: 364,857

[22] Filed: Jun. 12, 1989

[51] Int. Cl.[5] ..... A47L 7/00

[52] U.S. Cl. ..... 15/322; 15/419

[58] Field of Search ..... 15/321, 322, 419

[56] References Cited

U.S. PATENT DOCUMENTS

| | | | |
|---|---|---|---|
| 3,958,298 | 5/1976 | Cannan | 15/322 |
| 4,488,330 | 12/1984 | Grave | 15/322 |
| 4,584,736 | 4/1986 | Gremminger | 15/322 |
| 4,649,594 | 3/1987 | Grave | 15/322 |
| 4,654,925 | 4/1987 | Grave | 15/322 |

FOREIGN PATENT DOCUMENTS

| | | | |
|---|---|---|---|
| 2159696 | 12/1985 | United Kingdom | 15/322 |

*Primary Examiner*—Chris K. Moore

*Attorney, Agent, or Firm*—Leo Gregory

[57] ABSTRACT

A cleaning tool for a fluid vacuum type of cleaning machine having a demand-responsive air port for an automatic determination of air as required by the degree of suction exerted at the perimeter of the cleaning head to the end that there is an adequate stream of air entrained into the cleaning tool such that the cleaning fluid therein is effectively dispersed for engagement with the surface or surface covering material to be cleaned and for the avoidance of over or under powering the suction of the lower perimeter of the tool when engaged with various surfaces and surface coverings.

2 Claims, 4 Drawing Sheets

S
85
85a
85'
85'a
83
95
100
88
93
80a
81
80
99
40'
40'a
40'b
41
12
106
104
106a
103
105
105a
97
94
92
91
96

CLEANING TOOL WITH DEMAND-RESPONSIVE AIR PORT

BACKGROUND OF THE INVENTION

1. Field of the Invention

This invention relates to a cleaning tool attachment of a fluid vacuum cleaning machine.

2. Brief Description of the Previous Art

The applicant in his U.S. Pat. No. 4,488,330 provides adjustable air ports for air to become entrained into a stream of cleaning fluid to engage a surface to be cleaned.

The applicant in his U.S. Pat. No. 4,649,594 provides a manually adjustable air port.

Further applicant in his U.S. Pat. No. 4,654,925 in a cleaning tool structure provides open air ports for an air supply.

It is desired to have an improvement in supplying air to have the supply be responsive to demand as required by the operation of the machine.

SUMMARY OF THE INVENTION

It is a principal object herein to provide an automatic self adjustable air port which admits air to pass through subject to the demand for air by the relative suction at the perimeter of the nozzle of the cleaning machine.

Further it is an object of this invention to provide an air inlet formed as a diaphragm of which the passage of air therethrough is directly responsive to the suction exerted thereon, said suction being determined by the vacuum drawn upon the nozzle by the suction source of the machine.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
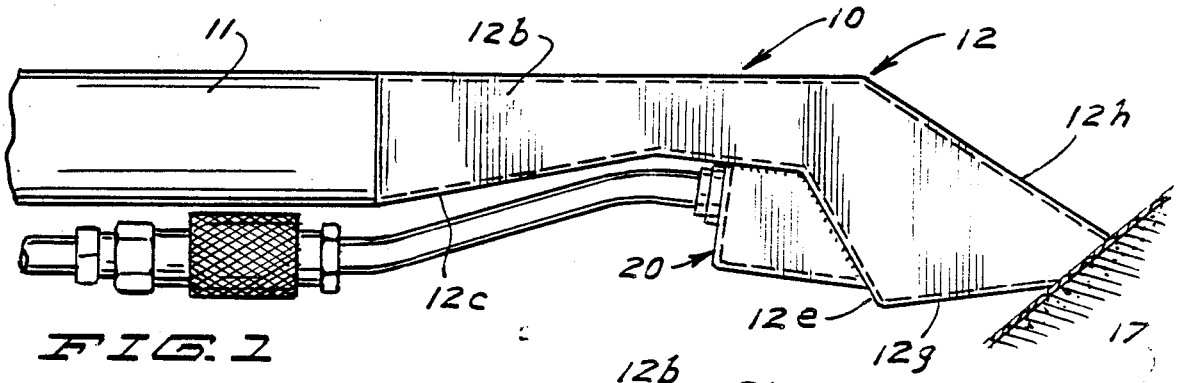
FIG. 1 is a broken view in side elevation.
Figure 2:
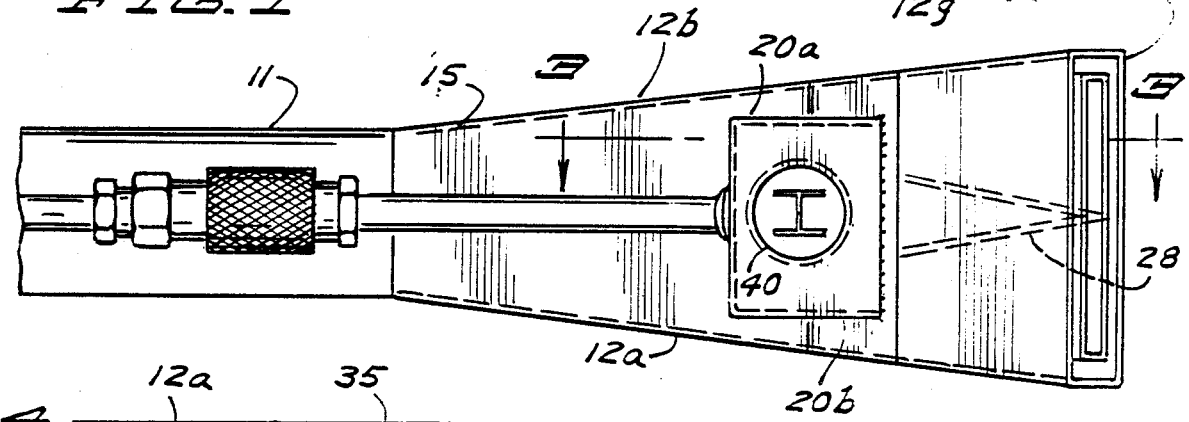
FIG. 2 is a broken view in bottom plan.

Referring particularly to FIGS. 1–7 of the drawings, the cleaning tool comprising the invention herein is indicated generally by the reference numeral 10. The remainder of the apparatus with which the cleaning tool is shown is intended for use is not shown. It may be referred to incidentally but forms no part of the present invention.

As seen in side elevation in FIGS. 1–7, said cleaning tool consists of a tubular housing portion 11 of the apparatus not here shown and a head section 12 forming a forward continuation thereof flaring transversely as it extends forwardly. The side walls **12*a* and 12*b* have their lower portions angled upwardly as indicated at 12*c* and is then angled downwardly as at 12*e* and finally is angled somewhat upwardly as at 12*g* to form a rectangular outlet 17 with the convergence of the upper portion of said side walls as at 12*h*.**

Said head section has an overlying top wall 15 and an underlying bottom wall 16.

Figure 3:
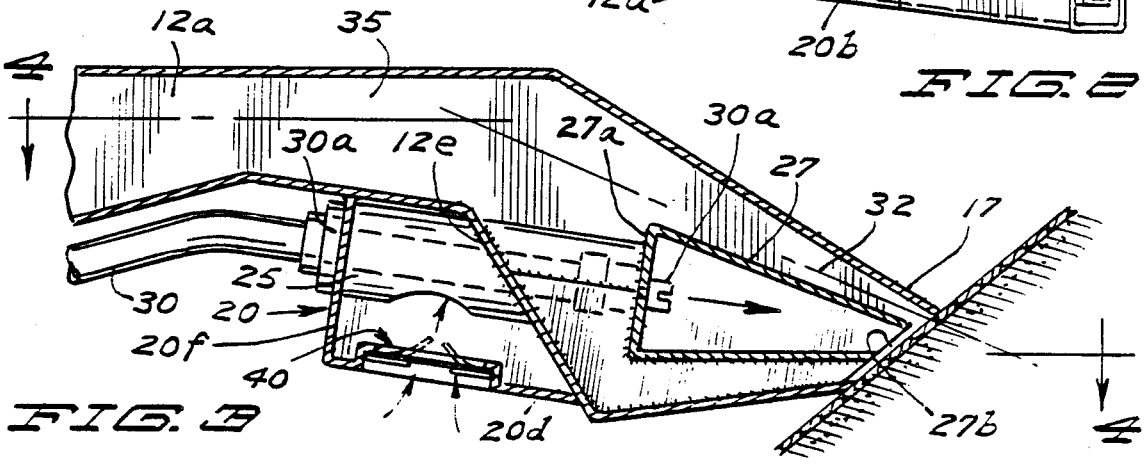
FIG. 3 is a view in vertical section taken on line 3—3 of FIG. 2 as indicated.
Figure 4:
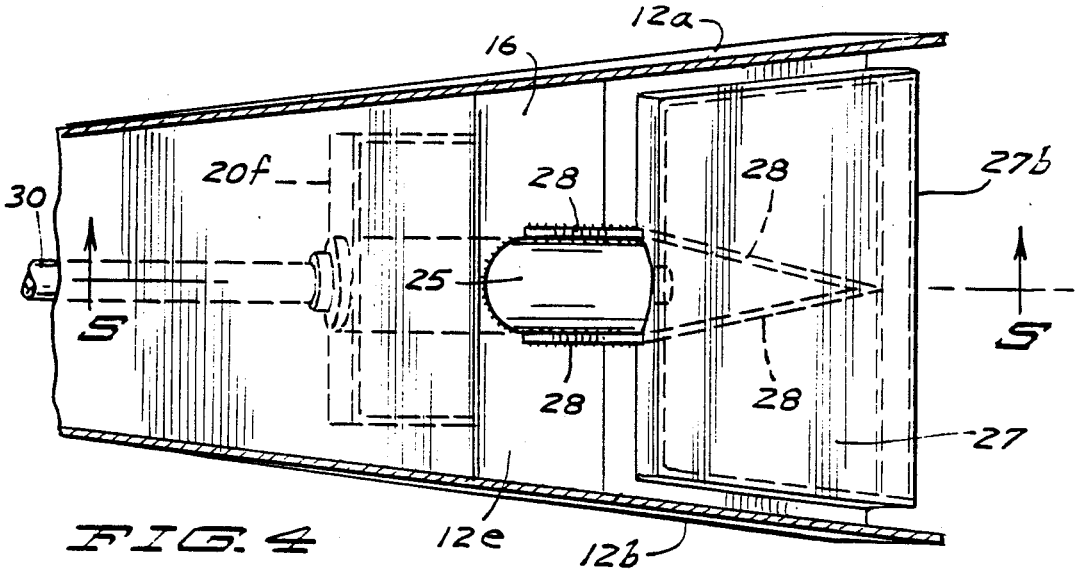
FIG. 4 is a view in horizontal section taken on line 4—4 of FIG. 3 as indicated.
Figure 5:
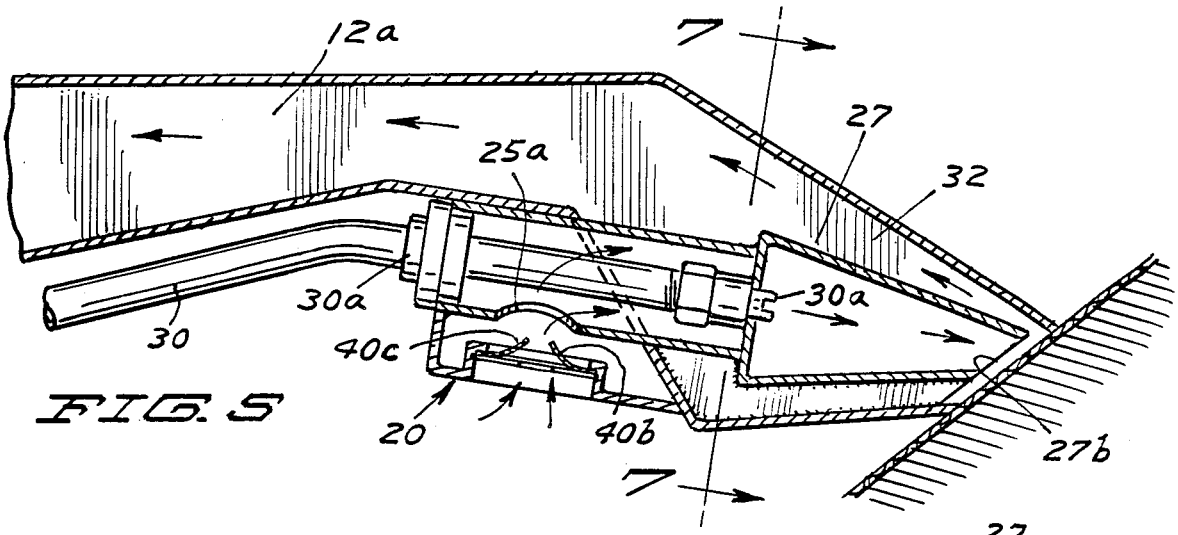
FIG. 5 is a view in vertical section taken on line 5—5 of FIG. 4 as indicated.
Figure 6:
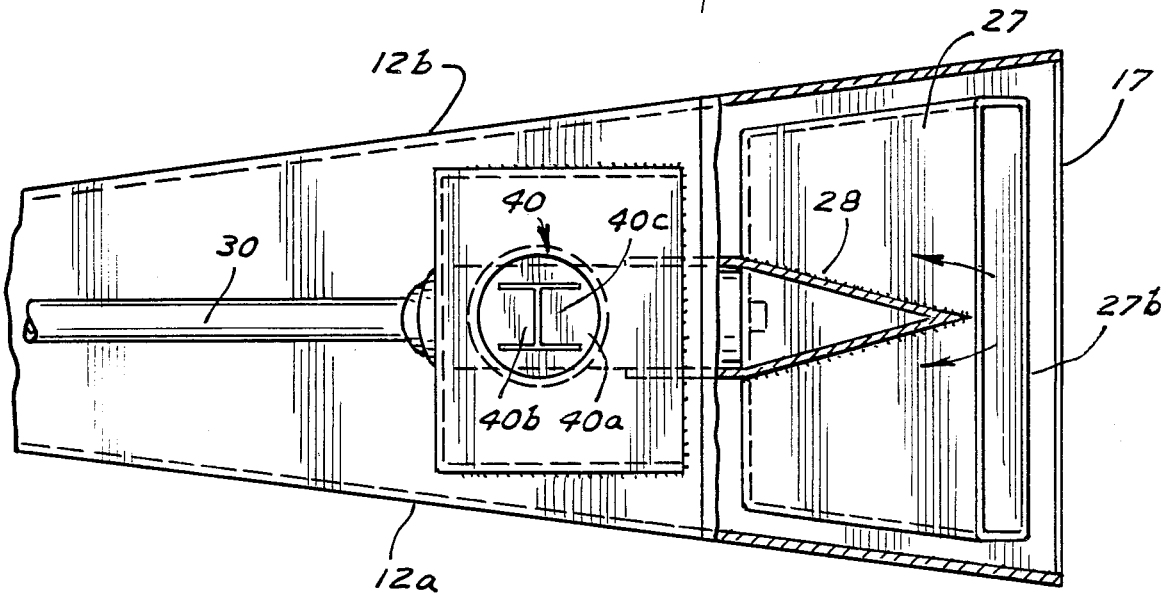
FIG. 6 is a broken view in bottom plan.

Referring particularly to FIGS. 3–5, an air chamber 20 is formed shown having side walls **20*a* and 20*b* extending rearwardly of the angled walls indicated by 12*e* and having a bottom wall 20*d* and a vertical rear wall 20*f*** all made to be integral with the adjacent walls of said head section.

Formed within said air chamber is a fairly large tubular member 25 extending forwardly through the bottom wall section **12*e* which forms the front wall of said air chamber. Said tubular member has extending forwardly thereof a fluid head 27 having a back wall 27*a* secured to said tubular member 25 and having a configuration to fairly correspond with the adjacent structure of head section 12 within which it is disposed and having an outlet 27*b* which corresponds to the outlet 17 being co-terminal therewith and being spaced inwardly thereabout from the sides of said outlet or nozzle 17**.

Underlying and supporting said fluid head 27 is a Vee shaped support 28 tapering forwardly to be secured to the bottom of said fluid head 27 and the adjacent surface of said bottom wall 16.

Underlying said tubular housing 11 and said head section 12 is a fluid line 30 coming from the main body of the apparatus not here shown and being connected to a suitable cleaning liquid source. Said fluid line runs into said air chamber 20 and extends through said tubular member 25 to said fluid head 27 being secured to said wall **27*a* and having a fluid jet 30*a* extending into said fluid head 27**.

The fluid line 30 and fluid head 27 will supply the cleaning fluid which will be dispersed through the outlet **27*b*.**

There is a passageway 32 between the outlet **27*b* and the outlet 17 which opens into the suction passage 35** which runs to the main body of the apparatus wherein means are provided to generate the suction to withdraw the cleaning fluid for discharge.

Figures 9, 10, 11, 12:
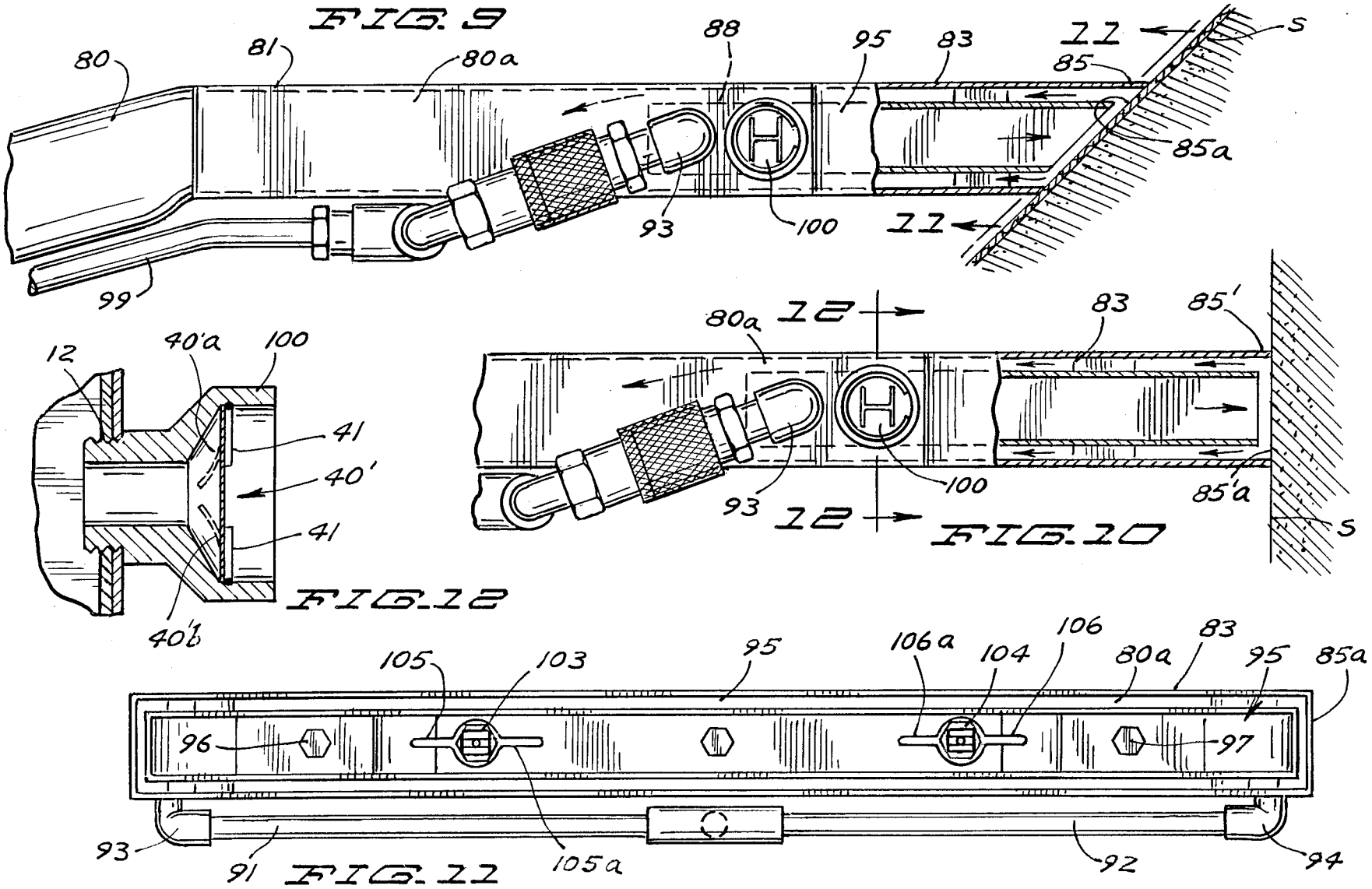
FIG. 9 is a side elevational view and partially in section taken on line 9—9 of FIG. 8 as indicated.
FIG. 10 is a view similar to that of FIG. 9 showing a modification thereof.
FIG. 11 is a view in end elevation taken on line 11—11 of FIG. 10 as indicated.
FIG. 12 is a view of a nozzle head in section taken on line 12—12 of FIG. 8 as indicated.

Now with particular reference to the air chamber 20, an air port 40 open to the atmosphere is provided in its bottom wall **20*d*. The air port, which is here shown to be circular in plan is formed having a disc inlet member 40*a* of a suitably yielding material and in the particular embodiment herein, said disc is shown comprising a pair of opposed cut out flaps 40*b* and 40*c* which, as illustrated in FIGS. 3 and 5, yield to suction to open and permit the passage of air. Said flaps are restrained by torsion springs 41 as shown in FIG. 12**.

Figure 7:
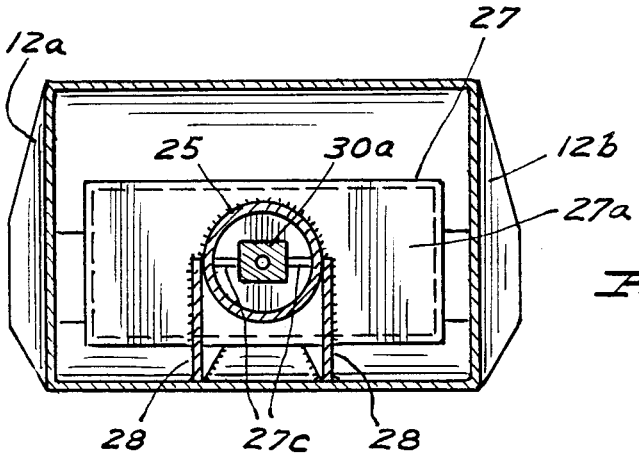
FIG. 7 is a view in vertical section taken on line 7—7 of FIG. 5 as indicated.
Figure 8:
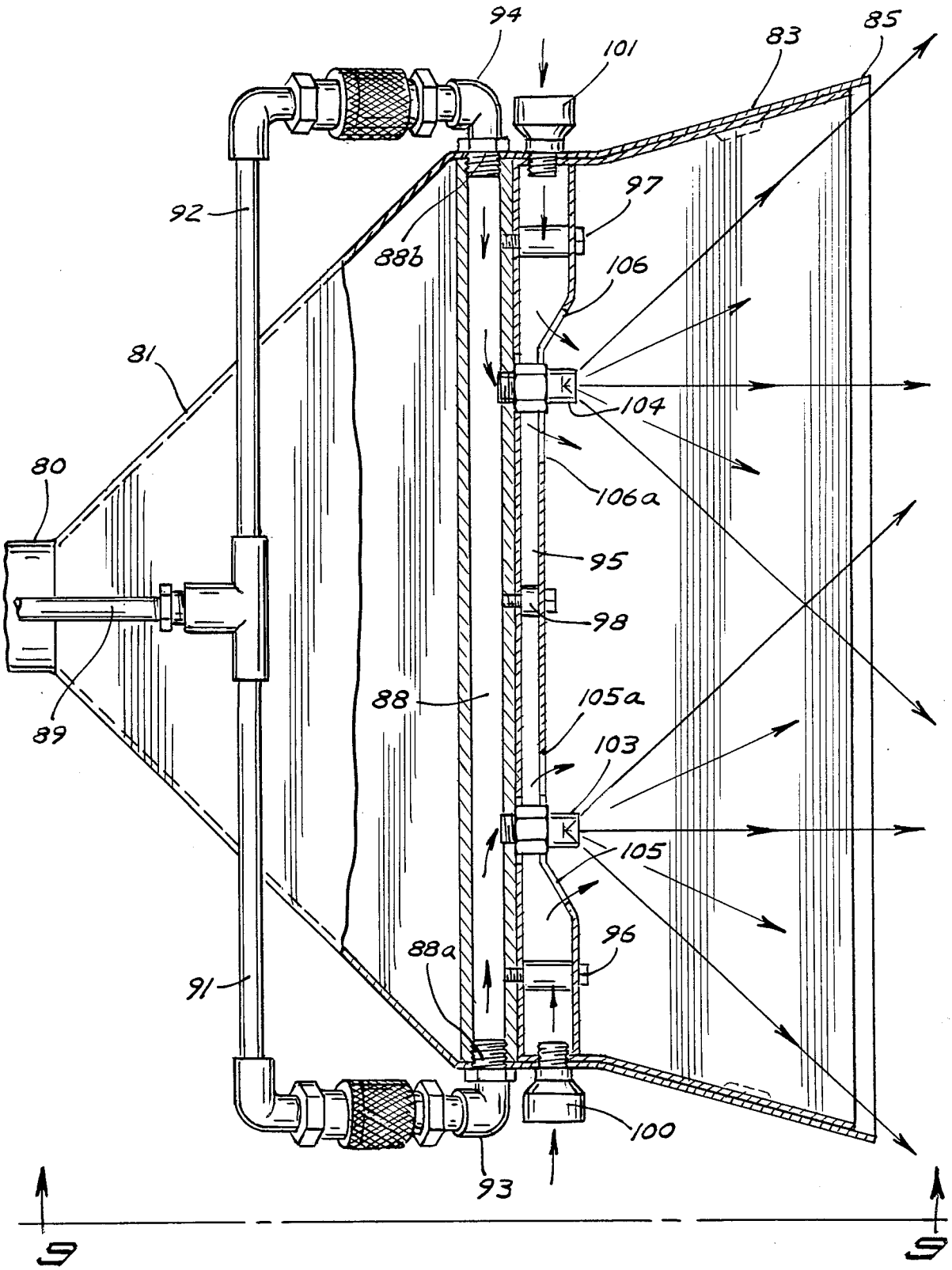
FIG. 8 is a bottom plan view.

Said tubular member 25 in said air chamber has an opening **25*a* therein above said port 40. Said air port provides air as demanded by the suction present at the outlet or nozzle 17 through the suction passage 35, said air passing into said nozzle though the slotted air passage 27c at either side of said jet 30a**, as shown in FIG. 7.

This valve structure represents a significant improvement in supplying air to the nozzle of a liquid vacuum type cleaner or cleaning head. It is important to have sufficient air for the purpose at hand. This is determined in a large part by the surface or surface material being cleaned. The air provides for the mobility of and the effective dispersal of cleaning fluid onto the surface being cleaned. The air port 40 is self operating and responds automatically to the demand for air at the nozzle. There is no adjustment required by the operator. Superior results are achievable herein with the improvement in porting air to provide automatically the air supply demanded by the cleaning effort.

The paths of air flow are illustrated by arrows in FIG. 5.

It is of interest to note that in the process of suctioning the cleaning fluid from the cleaned surface, there is no place in the exhaust passage nor any place around the fluid head 7 which will catch and retain contaminant material. Further as shown, the cleaning chamber 27 is a completely sealed unit to the point of dispersing cleaning fluid through the nozzle 27b.

MODIFICATION

Referring to the FIGS. 8–12, FIG. 8, is a bottom view showing a tubular housing portion 80 which extends forwardly to expand laterally and flare into a cleaning head 81 having therein a passage 80a. Said cleaning head has a nozzle 83 forwardly thereof on the order of the nozzle 53 and has a perimeter 85 rectangular in plan.

In FIG. 9, said perimeter is indicated as being angled with respect, to a vertical plane and is shown in connection with a surface S.

In FIG. 10, a modification is shown in which said perimeter is indicated as being 85' and as having side walls parallel to the plane of the surface S being cleaned.

The member 80 connects with a suction source in the body of the cleaning machine which is not shown and to which the structure here shown is an attachment. Said member 80 has therein a suction passage 80a which extends continuously through the cleaning head 81 and the nozzle 83 to the perimeter 85 where it communicates with the atmosphere.

At the juncture of said cleaning head and said nozzle is a transversely extending cleaning liquid manifold 88 substantially rectangular in cross section and of a height to have said passage 80a pass thereabove and therebelow as shown in FIGS. 9 and 10. Said manifold is secured at each end by pipe els 93 and 94 being threaded through the adjacent wall of the cleaning head and the end walls of said manifold as at 88a and 88b. A cleaning liquid line 89 running from a suitable cleaning liquid supply source is teed to have branches 91 and 92 respectively connected to the pipe fittings 93 and 94.

Disposed within said nozzle 83 and adjacent to said manifold 88 is an air manifold 95 secured to said manifold 88 by spacer bolts 96, 97 and 98 and having said passage 80a pass thereover and thereunder as shown in FIGS. 9 and 10.

Suitably threaded into each end of said air manifold are air ports 100 and 101 of which the air port 100 is shown in FIG. 12 in a sectional view having a threaded stem to be received and secured into the end of the manifold 95 as described. Said FIG. 12 shows the disc 40' with its flaps 40' and 140b' and the restraining torsion springs 41. These are demand responsive air ports as described in connection with the valve 40.

Extending from said liquid manifold and through said air manifold are liquid jets 103 and 104 which disperse cleaning liquid through the nozzle 83 and its perimeter 85 or 85' onto whatever surface is being cleaned.

Adjacent each of said jets are air ports or outlets 105, 105a, 106, and 106a for the passage of air from the ports 100 and 101 to be mixed with the liquid dispersed through the jets 103 and 104 into the nozzle. The liquid is supplied under substantial pressure to a surface being cleaned and is under constant movement in being sucked up from said surface being cleaned and is withdrawn through the exhaust passage 80a.

The movement of said liquid draws upon the air ports or openings 105, 105a and 106, 106a and this suction creates a responsive opening of the valves 100 and 101 for the supply of air in accord with the degree to which the valves respond. Thus there is automatically provided the air needed for a continuous movement of the cleaning liquid for engagement with and removal from the cleaned surface.

The cleaning action described successfully avoids puddling and performs so well in withdrawings cleaning liquid that only a slight amount of residue remains in the cleaned surface in the form of dampness.

The angled perimeter 85 is most appropriately used on liquid permeable surfaces and the perimeter 85' is most suitably used on non-permeable surfaces.

The demand responsive air ports have very efficiently provided the requisite amount of air required for mixture with the cleaning fluid and this entire operation of mixing air with the cleaning liquid responsive to the demand of suction at the perimeter of the cleaning tool is entirely an automatic operation.

It will of course be understood that various changes may be made in the form, details, arrangement and proportions of the product without departing from the scope of the invention which, generally stated, consists in a product capable of carrying out the objects above set forth, in the parts and combinations of parts disclosed and defined in the appended claims.

What is claimed is:

1. In connection with a fluid vacuum type cleaning apparatus, a cleaning tool comprising a hood having a chamber therein and forming a nozzle at its forward end, a tubular member communicating with said chamber and extending rearwardly of said hood to a suction source, a cleaning fluid line from a fluid source extending into said fluid chamber, a restrictive demand responsive air port open to the atmosphere communicating with said fluid chamber, a suction passage between said fluid chamber and said hood running to said tubular member from said nozzle, said demand responsive air port comprises a diaphragm having a pair of torsion spring restrained flaps flexing to have a restricted response to suction exerted thereupon.

whereby the suction drawn upon said nozzle determines the demand for air upon said air port and the air supplied by said port.

2. In connection with a vacuum type cleaning apparatus, a cleaning head structure comprising a hood having a chamber therein and forming a nozzle at its forward end, and forming a nozzle at its forward end, a tubular member communicating with said chamber and extending rearwardly to a suction source, a cleaning fluid chamber extending transversely within said chamber and having a nozzle coterminous with said hood nozzle, a fluid line having an inlet at each side of said fluid chamber into a fluid manifold, jets dispersing cleaning fluid from said manifold into and through said fluid chamber to said nozzle of said fluid chamber, an air manifold adjacent said fluid manifold, a diaphragm having restrained flaps forming a restrictive air demand responsive air port at each end of said air manifold, said demand responsive air ports being open to the atmosphere and communicating with said fluid chamber, a suction passage between said hood and said fluid chamber from said tubular member to said nozzle of said head, whereby the suction exerted upon said hood nozzle draws upon said fluid chamber and said air ports for an air supply, to co-mingle with the fluid in said fluid chamber in accordance with the cleaning requirements of said cleaning head within the restrictive limits of said diaphragms.

* * * * *

UNITED STATES PATENT AND TRADEMARK OFFICE

CERTIFICATE OF CORRECTION

PATENT NO. : 4,976,005

DATED : December 11, 1990

INVENTOR(S) : Dale L. Grave

It is certified that error appears in the above-identified patent and that said Letters Patent is hereby corrected as shown below:

On the title page, Item [76] the inventor's name should be corrected to read --Dale L. Grave--

Signed and Sealed this

Twelfth Day of February, 1991

*Attest:*

HARRY F. MANBECK, JR.

*Attesting Officer*

*Commissioner of Patents and Trademarks*